US011305204B1

(12) United States Patent
Nam et al.

(10) Patent No.: US 11,305,204 B1
(45) Date of Patent: Apr. 19, 2022

(54) MULTIPLE FACIAL EXPRESSION TOY FIGURE

(71) Applicant: Strottman International, Inc., Irvine, CA (US)

(72) Inventors: Peter Nam, Irvine, CA (US); John Martin, El Segundo, CA (US)

(73) Assignee: Strottman International, Inc., Irvine, CA (US)

( * ) Notice: Subject to any disclaimer, the term of this patent is extended or adjusted under 35 U.S.C. 154(b) by 93 days.

(21) Appl. No.: 16/879,700

(22) Filed: May 20, 2020

(51) Int. Cl.

| | |
|---|---|
| ***A63H 3/00*** | (2006.01) |
| ***A63H 3/12*** | (2006.01) |
| ***A63H 3/16*** | (2006.01) |
| ***A63H 3/44*** | (2006.01) |
| ***A63H 3/36*** | (2006.01) |

(52) U.S. Cl.
CPC ..... *A63H 3/16* (2013.01); *A63H 3/365* (2013.01); *A63H 3/44* (2013.01)

(58) Field of Classification Search
CPC ..... A63H 3/12; A63H 3/365
See application file for complete search history.

(56) References Cited

U.S. PATENT DOCUMENTS

| | | | | | |
|---|---|---|---|---|---|
| 2,584,798 | A * | 2/1952 | Goerditz | A63H 3/12 | 446/321 |
| 3,538,638 | A * | 11/1970 | Marvin | G11B 33/06 | 446/302 |
| 4,030,239 | A * | 6/1977 | White | A63H 3/12 | 446/321 |
| 4,136,483 | A * | 1/1979 | Shackelford | A63H 3/44 | 446/321 |
| 4,820,234 | A * | 4/1989 | Isaf | A63H 3/16 | 446/100 |
| 6,146,721 | A * | 11/2000 | Freynet | A47G 33/08 | 273/155 |
| 10,220,325 | B1 * | 3/2019 | Kelley | A63H 3/48 | |

* cited by examiner

*Primary Examiner* — John A Ricci
(74) *Attorney, Agent, or Firm* — Rutan & Tucker, LLP

(57) ABSTRACT

According to one embodiment, a toy figure featuring at least a body element, a head support element, a head element, and a head covering element. The head support element includes a second connector for coupling with a first connector of the body element. The head support element includes a base partially surrounded by sidewalls extending upwardly from a perimeter of the base to form a cavity and an opening between these sidewalls. The head element includes a conduit for slidably engaging the second connector and residing within the cavity. The head element includes a plurality of facial expressions, each placed on a different sidewall of the head element. A selected facial expression is aligned with the opening of the head support element. The plurality of facial expressions enables alteration of the selected facial expression of the toy figure based on rotation of the head element.

20 Claims, 6 Drawing Sheets

FIG. 3A
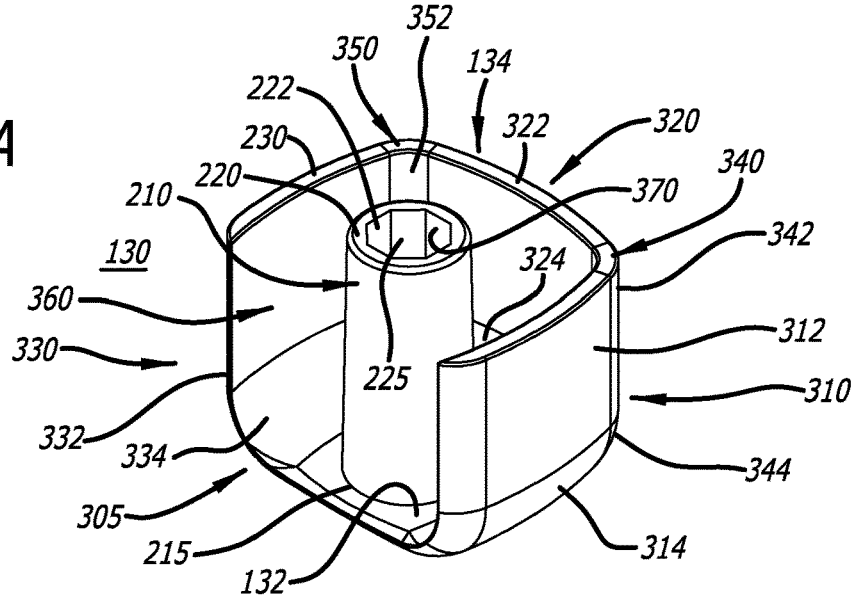
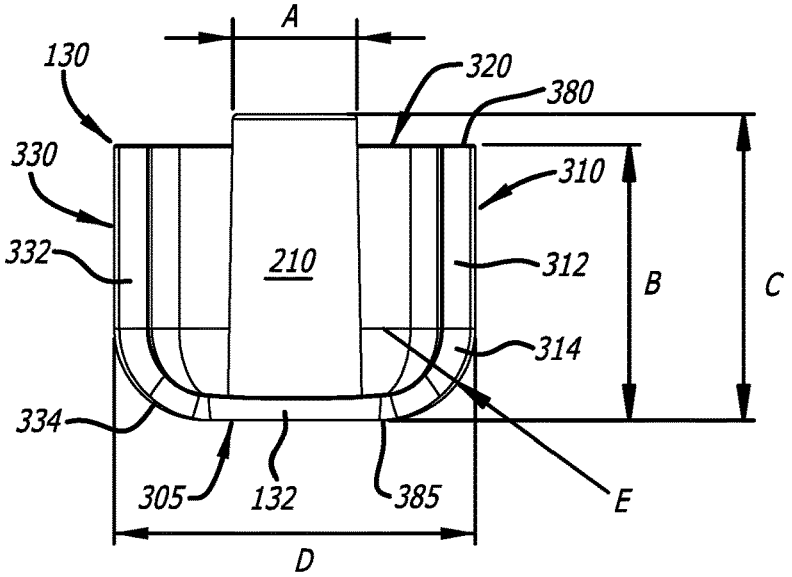
FIG. 3B
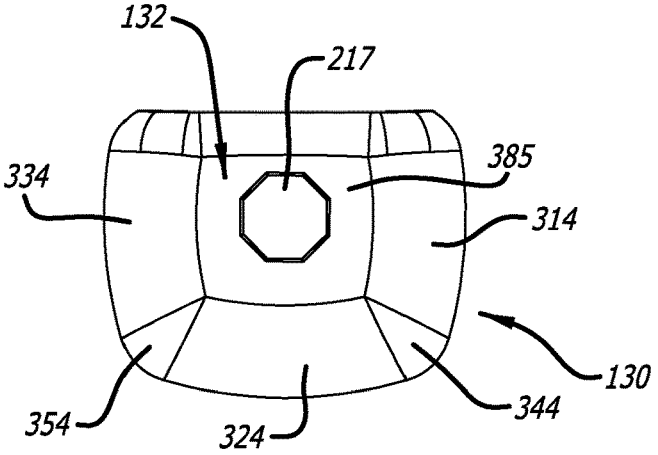
FIG. 3C

FIG. 4D
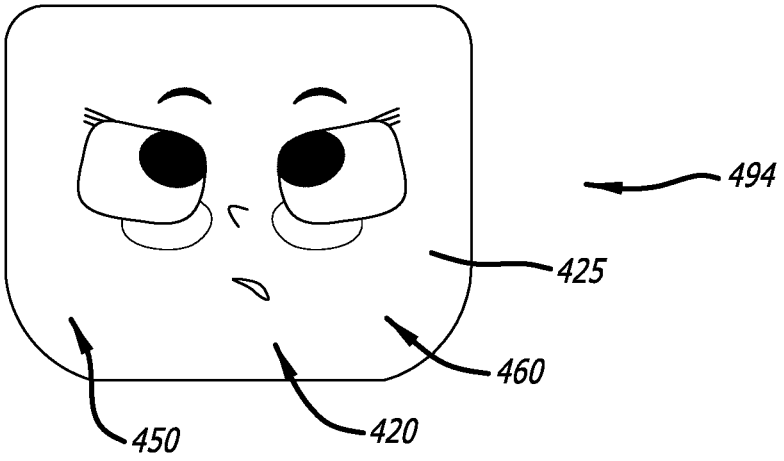
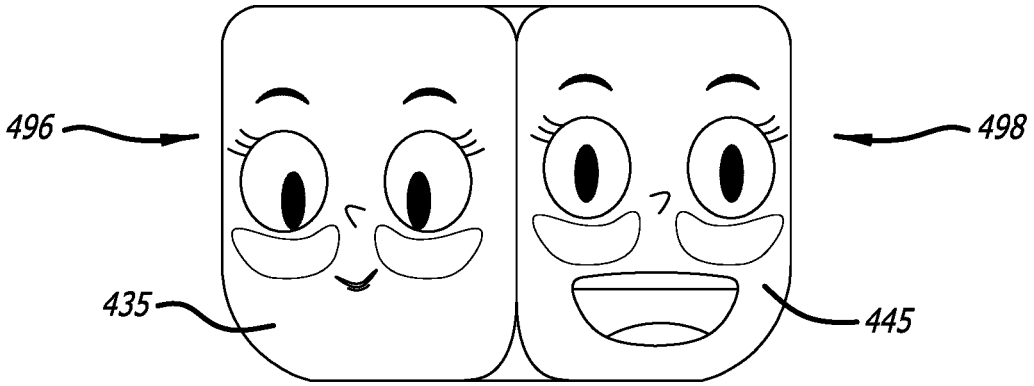
FIG. 4E

MULTIPLE FACIAL EXPRESSION TOY FIGURE

1. FIELD

Embodiments of the disclosure relate to the field of toy figures. More specifically, one embodiment of the disclosure relates to a customizable toy figure with a removable head element having a plurality of sidewalls each with a different facial expression so that a user can alter the facial expression for the toy figure.

2. GENERAL BACKGROUND

For decades, posable figures such as dolls or action figures have been commonly used as toys by children and as collectibles by adults. Typically, the shape of these posable figures has been provided with a human form, including a torso, a head, two arms and two legs. For some toy figure designs, ball and socket-type joints are used to connect the arms and legs to the torso so that the arms and/or legs are movable relative to the torso. For other designs, the toy figure is static without any moveable parts.

Independent of design type, one disadvantage associated with toy figures is that they are incapable of providing different facial expressions during playtime by children. For example, many of these posable figures have a single expression, and the expression cannot be altered to account for the imaginary situation in which the toy figure is being used. The lack of a mechanism to adjust the facial expressions of the figure may lead to lesser creative playtime.

BRIEF DESCRIPTION OF THE DRAWINGS

Embodiments of the invention are illustrated by way of example and not by way of limitation in the figures of the accompanying drawings, in which like references indicate similar elements and in which:

FIG. 3A is a perspective view of an exemplary embodiment of a head support element of the toy figure of FIG. 1.

FIG. 3B is a front plan view of the head support element of the toy figure of FIG. 3A.

FIG. 3C is a bottom plan view of the head support element of the toy figure of FIGS. 3A-3B.

FIG. 4D is a plan view of a second sidewall of the removable head element of FIGS. 4A-4B exhibiting a second facial expression.

FIG. 4E is a perspective view capturing a third and fourth sidewalls of the removable head element of FIGS. 4A-4B exhibiting third and fourth facial expressions.

DETAILED DESCRIPTION

Figure 1:
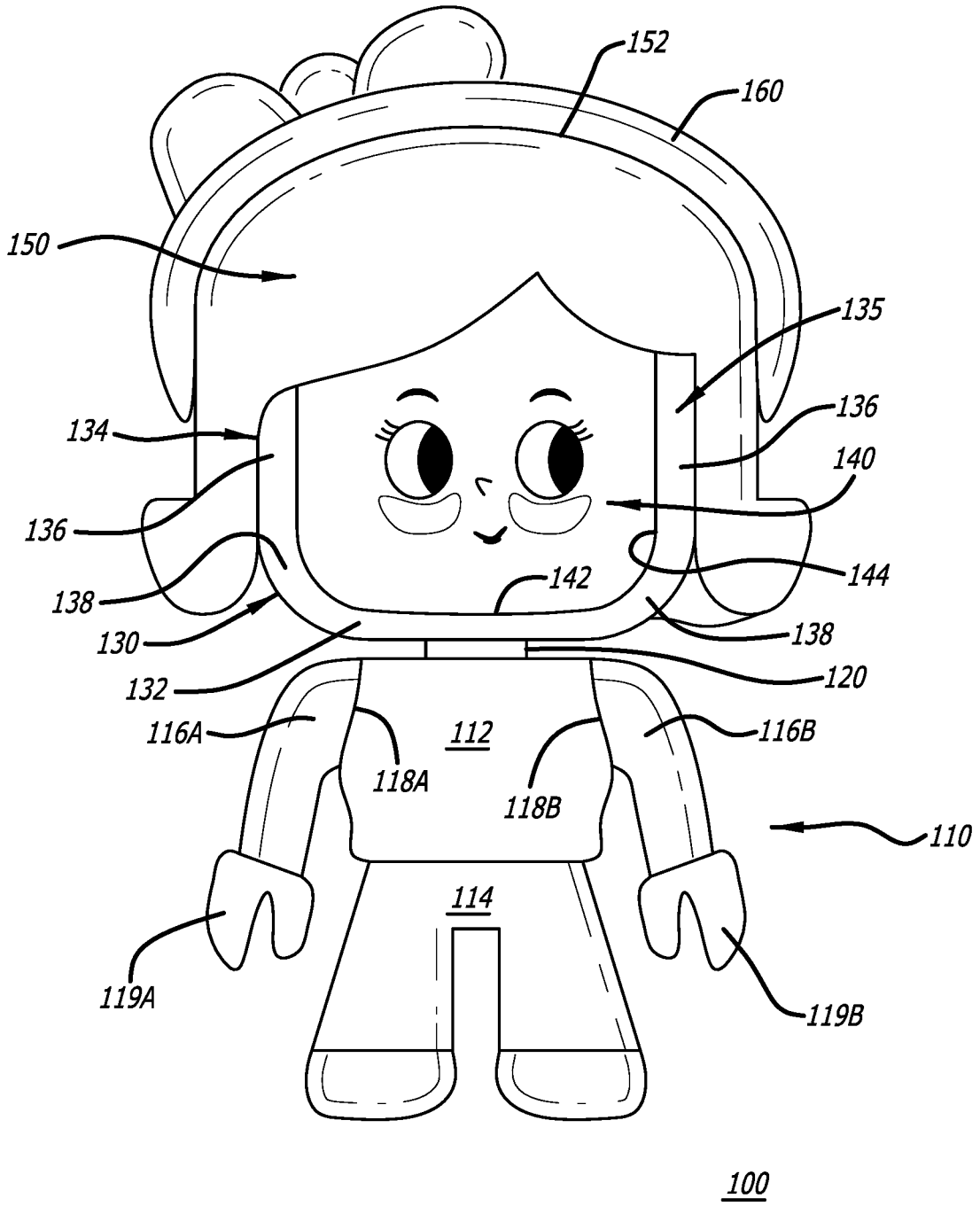
FIG. 1 is a perspective view of an exemplary embodiment of a toy figure according to one embodiment of the disclosure.

Various embodiments of the disclosure relate to a toy figure including removable components that, when coupled together, form the toy figure. These components, referred to as "elements," may include, but are not restricted to, at least the following: a body element, a head support element, a head element, and a head covering element. The removability of head element and head covering element from the head support element allows for rotation of the head element to alter the facial expression placed on the head element that is visible to the user after replacement into the head support element. Additionally, the alteration of the head covering element enables the toy figure to convey different roles (e.g., different hair styles, astronaut helmet, cowboy hat, etc.) as shown herein.

According to one embodiment of the disclosure, the body element features a torso with a pair of legs integrated as part of the torso, a pair of arms rotationally coupled to upper side portions of the torso, and a first connector (e.g., male connector such as a post) extended from a top portion of the torso between the upper side portions. The head support element includes a second connector (e.g., female connector such as a receiver), which is sized to receive and establish a secure, yet removable, coupling with the first connector. Herein, the head support element is formed as a concave-shaped housing including a base and a first plurality of interconnecting sidewalls extending from only a portion of base perimeter. Collectively, the base and interconnecting sidewalls form a cavity in which the second connector is positioned. The housing further includes a front-facing opening (e.g., no sidewalls along a front section of the housing) to provide visibility to a selected sidewall of the head element.

The head element features a housing including at least a bottom wall and a second plurality of sidewalls positioned along with entire perimeter of the bottom wall. The exterior-facing surfaces of the bottom wall and the second plurality of sidewalls are complementary in shape to the inner surfaces of the base and sidewalls of the housing forming the head support element. In particular, according to one embodiment of the disclosure, the head element may be constructed with a rounded cube structure, rectangular box structure, a rounded cube or box structure with a missing a top wall, or the like. Facial expressions may be placed (e.g., printed, drawn, etched, etc.) on the outer-facing surfaces of multiple (two or more) sidewalls of the head element. One of these facial expressions is aligned with the front-facing opening of the head support element that is created, and thus, is visible to the user.

Upon insertion, the head element resides within the cavity of the head support element and is incapable of being rotated without removal of the head element from the cavity. According to one embodiment of the disclosure, the head element features four (4) sidewalls, where a front side surface of each of the sidewalls includes a different type of facial expression. Therefore, a change in facial expression for the toy figure may be accomplished by removing the head element from the head support element, laterally rotating the head element to a different facial expression included on the head element, and re-positioning the rotated head element onto the second connector of the head support element.

A head covering element includes a third connector, which is removably coupled to an end of the second connector of the head support element, and as a result, the second connector may operate as both a male connector for the head covering element and as a female connector for the body element. The head covering element provides a visual impression as to the activity represented by the toy figure (e.g., hair, certain types of helmets to represent an astronaut, race car driver, soldier, construction worker, etc.).

I. Terminology

In the following description, certain terminology is used to describe features of the invention. For example, in certain situations, the term "element" is representative of a physical structure that may be oriented in any shape or decorated in accordance with any color pattern. The element may be constructed with any type of rigid or semi-rigid material including, but not limited or restricted to, a polymer (e.g., polyethylene, polypropylene, poly vinyl chloride, acrylonitrile butadiene styrene, etc.), a metal, an organic material (e.g., wood, etc.), or the like.

As broadly construed, the term "toy figure" generally refers to a posable figure in any form, such as human, animal, alien or a combination thereof; an action figure with any combinations of the torso (arms, limbs, etc.) being movable; a collectable, or the like.

Lastly, the terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

As this invention is susceptible to embodiments of many different forms, it is intended that the present disclosure is to be considered as an example of the principles of the invention and not intended to limit the invention to the specific embodiments shown and described.

II. General Architecture

Referring to FIG. 1, a perspective view of an exemplary embodiment of a toy FIG. 100 is shown. According to this illustrative embodiment, the toy FIG. 100 comprises a body element 110, a head support element 130, a head element 140, a head covering element 150, and an accessory attachment element 160. The head support element 130 is removably coupled to the body element 110 through a first connector pair (see FIG. 2). The head element 140 is sized and shaped to be retained within the head support element 130 while the head covering element 150 is removably coupled to the head support element 130 through a second connector pair (see FIG. 2). The accessory attachment element 160 is removably coupled to the head covering element 150 through a third connector pair (see FIG. 2).

Herein, according to one embodiment of the disclosure, the body element 110 features a upper torso 112 and a lower torso 114, which includes a pair of legs and may be integrated with the upper torso 112 as a single component. The body element 110 may include a pair of arms 116A and 116B which are rotationally coupled to side areas 118A and 118B of the upper torso 112. Each of the rotatable arms 116A and 116B includes hand component 119A and 119B, which are configured with a spacing between a first (thumb) portion and a second (fingers) portion to allow for insertion and retention of hand-held accessories (not shown). For example, a hand-held accessory may include, but is not limited or restricted to a toy wrench, a toy basket, or other accessories to accompany the toy FIG. 100.

Figure 2:
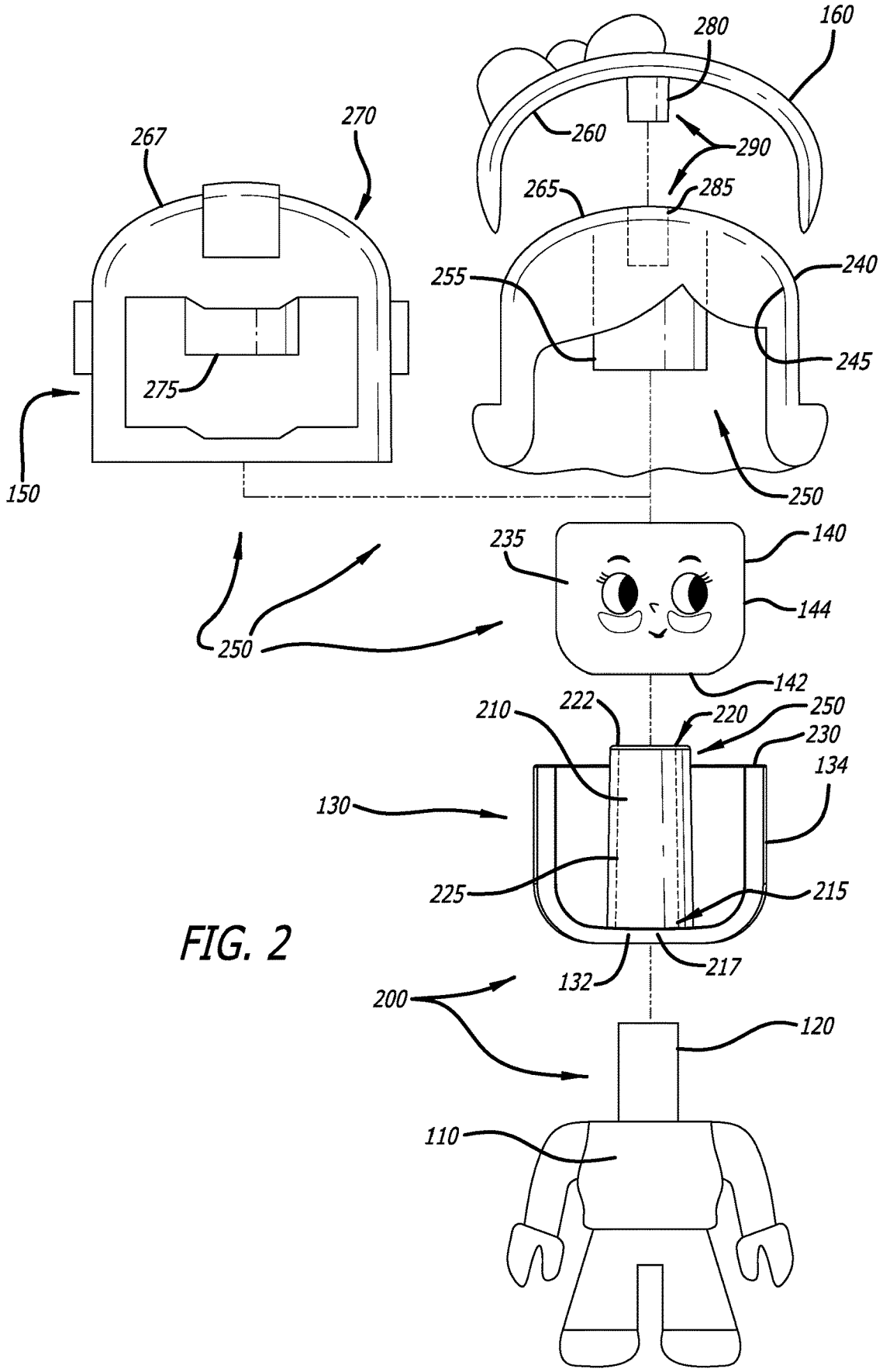
FIG. 2 is an exploded view of the exemplary embodiment of the toy figure of FIG. 1 illustrating different head covering elements.

The body element 110 further includes a first connector 120 oriented as a male connector such as a post-like structure. The first connector 120 is removably coupled to a second connector (not shown) of the head support element 130; namely the first (male) connector 120 of the body element 110 is inserted in the second (female) connector accessible via a base 132 of the head support element 130 to secure the body element 110 and the head support element 130 together. Further details of the connectivity between the body element 110 and the head support element 130 is shown in FIG. 2 and described below.

The head support element 130 includes a concave-shaped housing 135 with its inner surfaces forming a cavity, where the housing 135 includes with the base 132 and a first plurality of sidewalls 134 extending upwardly from and partially surrounding a perimeter of the base 132. Each sidewall 134 may include a side panel segment 136 and an intermediary wall segment 138 having an increasing sloped surface for interconnecting the base 132 to the side panel segment 136. The sidewalls 134 extend from the base 132 to form a first U-shaped cross-section visible from at least a top plan view of the housing 135 and a second U-shaped cross-section that is visible from at least a front plan view of the housing 135, as shown.

According to one embodiment of the disclosure, the head element 140 is slidably inserted into and resides entirely within the cavity formed by the housing 135 of the head support element 130. In particular, the head element 140 includes a bottom wall 142 and a second plurality of sidewall 144, both of which are formed with exterior-facing surfaces complementary to inner surfaces of the base 132 and the first plurality of sidewalls 134 of the head support element 130. It is contemplated that the tolerances between bottom wall/sidewall 142/144 of the head element 140 and inner surfaces of the housing 135 for the head support element 130 may be less than 0.1 inches, where the separation enables easier removal of the head element 140 from the head support element 130 while, at the same time, precluding rotation of the head element 140 when residing within the cavity formed by the housing 135 of the head support element 130.

The head covering element 150 is formed to fit over the top sections of the head element 140 and the head support element 130. Although not shown, for this embodiment of the disclosure, the head covering element 150 is coupled to the second connector of the head support element 130, not the head element 140. Additionally, an optional ancillary attachment element 160 is removably coupled to the head covering element 150 through a third connector pair (e.g., male/female connectors) in which the ancillary attachment member 160 may include a male connector (e.g., post member) for insertion into a female connector accessible from a portion of a top surface 152 of the head covering element 150.

Referring now to FIG. 2, an exploded view of the exemplary embodiment of the toy FIG. 100 of FIG. 1, which is configured to deploy different head covering elements, is shown. Herein, the body element 110 is coupled to the head support element 130 through a first connector pair 200. In particular, the first connector pair 200 includes the first connector 120 of the body element 110, which is removably coupled to a second connector 210 of the head support element 130. According to one embodiment of the disclosure, the first connector 120, operating as a male connector, is sized for insertion into an elongated conduit 225 of the second connector 210 of the head support element 130. Operating as a female connector for the first connector pair 200, the second connector 210 may be formed with a cylindrical-shape, including a first end 215 and a second end 220. The first end 215 includes a first opening 217 for the elongated conduit 225 extending partially or entirely through the connector 210, where the first opening 217 is positioned along the base 132 of the head support element 130. The second end 220 includes a second opening 222 of the conduit 225, where the second connector 210 extends above a top edge 230 of the sidewalls of the head support element 130.

According to one embodiment the disclosure, the cylindrical-shaped connector 210 and its conduit 225 may taper from the first end 215 towards the second end 220 so that the diameter of the conduit 225 at the first opening 217 (e.g., diameter or width representing a first distance between opposite sides of the conduit 225 near the first end 215) is greater than a second diameter of the conduit 225 at the second opening 222 (e.g., diameter or width representing a distance between opposite sides of the conduit 225 near the second end 220). As a result, the first connector 120 is inserted through the first opening 217 and into the conduit 225 until the first connector 120 is forcibly lodged between the inner surfaces of the conduit 225 to secure the head support element 130 to the body element 110 (e.g., the diameter or width of the first connector 120 is smaller than the inner diameter or width of the conduit 225 near the first end 215 but is larger than the inner diameter or width of the conduit 225 near the second end 220).

Referring still to FIG. 2, the head element 140 includes a conduit sized with a diameter equal to or greater than an outer diameter of the second connector 210 (e.g., the width of the second connector 210 from oppositely arranged exterior surfaces). This allows the head element 140 to slide from the second end 220 to the first end 215 of the cylindrical-shaped connector 210. As a result, an exterior-facing surface of the bottom wall 142 of the head element 140 resides upon and rests against an inner (top) surface of the base 132 of the head support element 130 and the exterior-facing surfaces of the sidewalls 144 of the head element 140 are generally positioned to reside adjacent to (e.g., in parallel with) inner surfaces of the sidewalls 134 of the head support element 130. The head element 140 includes a facial expression 235 that is positioned to be visible between an opening (spacing) between the sidewalls 134 and multiple, different facial expressions facing the sidewalls 144 along a lateral perimeter of the head element 140 as shown in FIGS. 4A-4E and described below.

As further shown in FIG. 2, the head covering element 150 may be of any type or form such as hair 240 or a helmet 270 as shown. The head covering element 150 is configured to be removably coupled to the head support element 130 via a second connector pair 250. Herein, according to one embodiment of the disclosure, the second connector pair 250 may include a third connector 255 positioned along an inner surface 245 of the head covering element 150 (e.g., hair 240). As shown, the third connector 255 extends outwardly from the inner surface 245 of the head covering element 240 for coupling to the second connector 210.

More specifically, the third connector 255 operates as a female connector while the second connector 210, which operates as a female connector in the first connector pair 200, now operates as a male connector in the second connector pair 250. More specifically, the third connector 255 of the head covering element 240 is configured as a single closed-end, tube-like structure with a diameter that is slightly greater than an outer diameter of the second end 220 of the second connector 210 so as to at least slidably engage therewith, until the diameter (or width) of the connector 210 of the head support element 130 has the diameter (or width) that is equal to the diameter of the third connector 255. At that time, the head covering element 240 is secured to the head support element 130. A similar attachment can be performed with the helmet 270 in which a female connector 275, positioned within the helmet 270, is sized to the diameter (or width) that is greater than the diameter (or width) at the second end 220 but fits snugly as the second connector 210 may be tapered so that the exterior diameter (or width) of the second connector 210 increases from the second end 220 to the first end 215 of the second connector 210.

Additionally, the ancillary attachment member 160 may include a fourth (male) connector 280 that engages with an opening 285 within the head covering element 240 or 270, which collectively form the third connector pair 290. More specifically, the fourth connector 280 may be inserted into the opening 285 until an inner surface 260 of the ancillary attachment member 160 is in contact with an outer surface 265 or 267 of the head covering element 240 or 270. At this stage, the fourth connector snugly fits within the opening 285.

Referring now to FIG. 3A, a perspective view of an exemplary embodiment of the head support element 130 of the toy FIG. 100 of FIG. 1 is shown. Herein, the head support element 130 comprises the base 132 and the plurality of sidewalls 134, with the second connector 210 positioned on the base 132. Partially surrounding the second connector 205, the plurality of sidewalls 134 are positioned to generally form a U-shaped structure 300 as outlined by top edges 230 of the sidewalls. A front portion of the head support element 130 remains open to generally for a U-shaped opening 305.

According to this embodiment of the disclosure, each of the plurality of sidewalls 134 may feature a side panel segment and an intermediary wall segment having an increasing sloped surface to interconnect the base 132 with the side panel segment. More specifically, the plurality of sidewalls 134 include a first (right) sidewall 310 featuring a first side panel segment 312 and a first intermediary wall segment 314, a second (back) sidewall 320 featuring a second side panel segment 322 and a second intermediary wall segment 324, and a third (left) sidewall 330 featuring a third side panel segment 332 and a third intermediary wall segment 334. Additionally, a first angular sidewall 340 may be interposed between the first sidewall 310 and the second sidewall 320 and a second angular sidewall 350 may be interposed between the second sidewall 320 and the third sidewall 330. The angular sidewalls 340 and 350 feature side panel segments 332 and 342 and intermediary wall segments 334 and 344 with a greater radius of curvature than sidewalls 310, 320 and/or 330. As a result, the collection of the base 132, the plurality of sidewalls 310, 320 and 330 along with the plurality of angular sidewalls 340 and 350 produce a concave-shaped housing with a cavity 360 in which the second connector 210 is maintained.

Positioned on the base 132, according to one embodiment of the disclosure, the second connector 210 may be constructed as a cylindrical-shaped connector. The cylindrical-shaped connector 210 includes the first end 215 with the first opening 217 (see FIG. 3C) and the second end 220 including the second opening 222. The elongated conduit 225 extends partially or entirely through the connector 210, where an inner surface 370 of the conduit 225 may feature a polygon-shaped cross section (e.g., octagon-shaped, hexagon-shaped, pentagon-shaped, etc.). Herein, according to one embodiment of the disclosure, the cylindrical-shaped connector 210 may be narrowly tapered from the first end 215 to the second end 220 of the cylindrical-shaped connector 210. It is contemplated that the tapering enables the first connector pair 200 to establish a secure connection without requiring precise tolerances for both the first connector 120 and the second connector 205.

Referring to FIG. 3B, the front plan view of the head support element 130 of the toy FIG. 100 of FIG. 3A is shown. Herein, according to one embodiment of the disclosure, the front opening 305 provides a viewing region of a single sidewall 310, 320 or 330 of the head element 140 positioned to surround the cylindrical-shaped connector 210, which is situated generally equidistant from the first sidewall 310 and the third sidewall 330. The outer diameter (A) of the cylindrical-shaped connector 210 may be less than 0.5 inch (e.g., 0.46 inches), namely, a diameter smaller than a diameter of a conduit 400 for the head element 140 as shown in FIG. 4B.

As further shown in FIG. 3B, the first sidewall 310 features the first side panel segment 312 and the first intermediary wall segment 314, which collectively having a height (B) ranging slight greater than one inch, such as 1.03 inches as measured from a bottom surface 385 of the base 132 to a top edge 380 of the sidewall (e.g., edge 380 of the first sidewall 310) for example. Similarly, the second sidewall 320 and the third sidewall 330 are constructed with a height equal to the height (B) of the first sidewall 310. Shown as an illustrative example, the second connector 210 may be sized with a height (C) that exceeds the depth of the cavity 360 formed by the plurality of sidewalls 310, 320 and 330, where height (C) may be equal to 1.14 inches when the height (B) of the first sidewall 310 is equal to 1.03 inches. The width (D) of the head support element 130 between the first side panel segment 312 and the third side panel segment 332 may be equal to 1.34 inches in accordance with one example of the embodiment. The intermediary wall segments 314, 324 and/or 334 may be formed with a radius of curvature of 0.34 inches in accordance with this embodiment of the disclosure. Of course, other selected sizes may be deployed for different embodiments.

Referring now to FIG. 3C, a bottom plan view of the head support element 130 of the toy FIG. 100 of FIGS. 3A-3B is shown. Herein, according to one embodiment of the disclosure, the head support element 130 features the base 132 including the bottom surface 385 featuring the opening 217 for the cylindrical-shaped connector 210. The intermediary wall segments 314, 324, 334, 344 and 354 partially surround the base 132.

As shown, according to one embodiment of the disclosure, the opening 217 is shown to be octagonal in shape, but may be deployed as any shape suitable for securely coupling the first connector (post) 120 of the body element 110 to the head support element 130. Herein, as shown in both FIGS. 3A & 3B, the shape of the opening 217 and its corresponding cross-sectional shape of the conduit 225 are illustrated in octagonal form, as the different segments of the octagon-shaped conduit 225 may apply pressure against the post-like component operating as the first connector 120 therein, but provide sufficient spacing (non-contact) to enable easier removal of the head support element 130 from the body element 110.

Figure 4A:
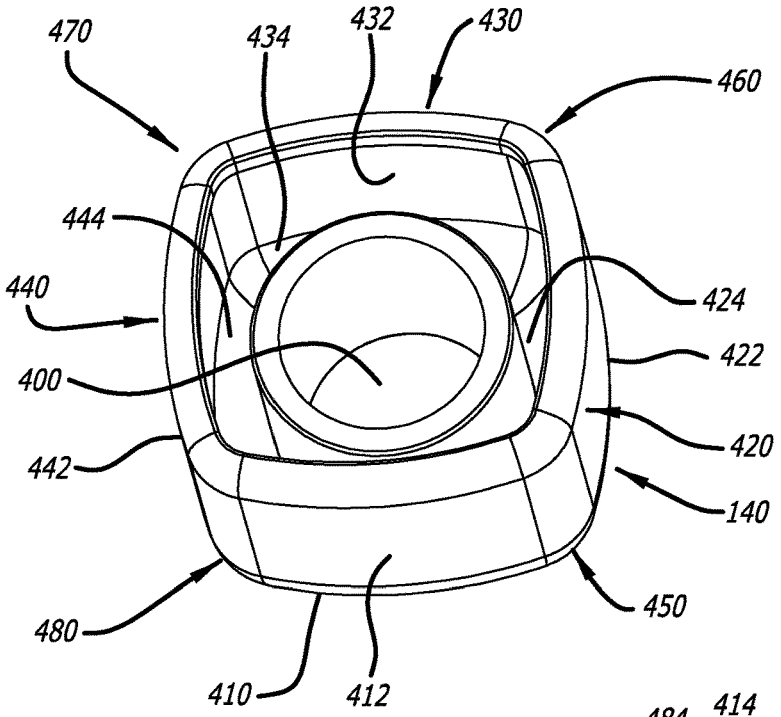
FIG. 4A is a perspective view of an exemplary embodiment of a removable head element of the toy figure of FIG. 1.
Figure 4B:
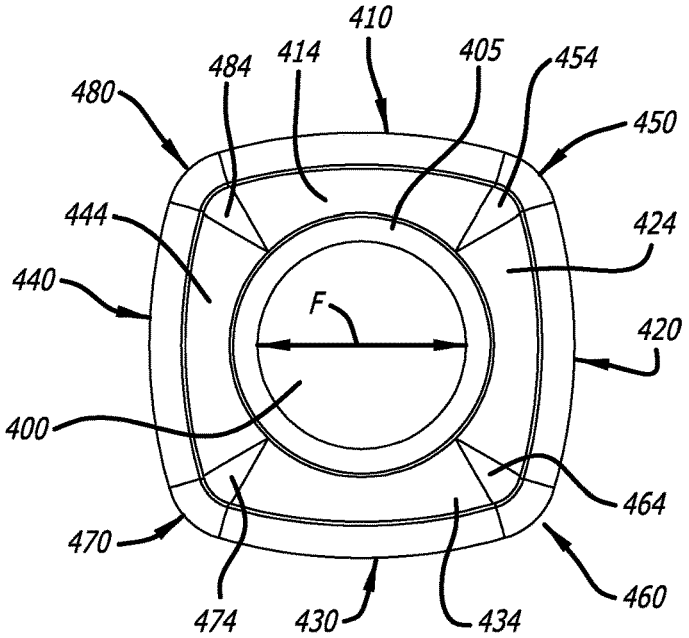
FIG. 4B is a top plan view of the removable head element of FIG. 4A.

Referring now to FIG. 4A, a perspective view of an exemplary embodiment of the removable head element 140 of the toy FIG. 100 of FIG. 1 is shown. The head element 140 includes a second conduit 400 providing an opening within the bottom wall 405 forming a portion of the bottom surface of the head element 140. A plurality of sidewalls 410, 420, 430 and 440, inclusive of a corresponding plurality of side panel segments 412, 422, 432 and 442 and intermediary wall segments 414, 424, 434 and 444, are arranged to surround the second conduit 400 as shown in FIGS. 4A-4B.

Additionally, a first angular sidewall 450 may be interposed between the first sidewall 410 and the second sidewall 420 of the head element 140. Similarly, a second angular sidewall 460 may be interposed between the second sidewall 420 and the third sidewall 430; a third angular sidewall 470 may be interposed between the third sidewall 430 and the fourth sidewall 440; and a fourth angular sidewall 480 may be interposed between the fourth sidewall 440 and the first sidewall 410. Similar to sidewalls 410-440, the angular sidewalls 450, 460, 470 and 480 feature side panel segments 452, 462, 472 and 482 and intermediary wall segments 454, 464, 474 and 484 with a greater radius of curvature than sidewalls 410, 420, 430 and/or 440.

Referring now to FIG. 4B, a top plan view of the removable head element 140 of FIG. 4A is shown. Herein, according to one embodiment of the disclosure, the second conduit 400 features a diameter (F) that is larger in size than the outer diameter of the cylindrical-shaped connector 210 as shown in FIGS. 3A-3B. For example, the second conduit 400 may be sized with a diameter (F) of approximately 0.58 inches between inner side surfaces of the conduit 400, where the outer diameter of the cylindrical-shaped connector 210 is approximately 0.46 inches. Herein, the outer surface of the bottom wall 405 and portions of the intermediary wall segments 414-484 are formed to be complementary to an inner (top) surface of the base 132 and portions of the intermediary wall segments 312, 322, 332, 342 and 352 of the head support element 130.

Figure 4C:
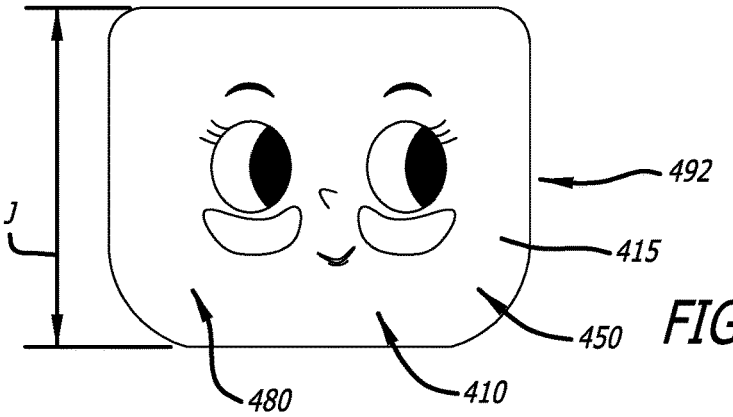
FIG. 4C is a plan view of a first sidewall of the removable head element of FIGS. 4A-4B exhibiting a first facial expression.

Referring to FIG. 4C, a plan view of a first side surface of the removable head element 140 of FIGS. 4A & 4B is shown. Herein, a first side surface 490, which includes a portion of the first sidewall 410 (e.g., side panel segment 412 and a portion of the intermediary wall segment 414) along with portions of the first and fourth angular sidewalls 450 and 480, includes a facial expression 415. Stated different, the facial expression 415 may extend along a portion of the first sidewall 410 and optionally portions of one or more neighboring angular sidewall 450 and/or 480. As a result, the head element 140 provides four different facial expressions positioned primarily along the different sidewalls 410, 420, 430 and 440 as shown in FIGS. 4D-4E.

In particular, as shown in FIG. 4D, a plan view of the second side surface 494 of the removable head element of FIGS. 4A-4B exhibiting a second facial expression 425. According to one embodiment of the disclosure, the second side surface 494 includes a portion of the second sidewall 420 (e.g., side panel segment 422 and a portion of the intermediary wall segment 424) along with portions of the first and second angular sidewalls 450 and 460. As shown, the second facial expression 425 may extend along a portion of the second sidewall 420 and perhaps a portion of a neighboring angular sidewall 450 and/or 460.

Referring to FIG. 4E, a perspective view of the third and fourth sidewalls 430 and 440 of the removable head element 140 of FIGS. 4A-4B, exhibiting a third facial expression 435 and a fourth facial expression 445 is shown. According to one embodiment of the disclosure, the third side surface 496 includes a portion of the third sidewall 430 (e.g., side panel segment 432 and a portion of the intermediary wall segment 434) and perhaps portions of the second and third angular sidewalls 460 and 470. Similarly, the fourth side surface 498 includes a portion of the fourth sidewall 440 (e.g., side panel segment 442 and a portion of the intermediary wall segment 444) and perhaps portions of the third and fourth angular sidewalls 470 and 480. As further shown, the third facial expression 435 may be produced on the third side surface 496 while the fourth facial expression 445 may be produced on the fourth side surface 498. Hence, lateral rotation of the head element 140 and re-connection to the second connector 210 allows the user to alter the facial expression of the toy FIG. 100 shown in FIGS. 1-2.

Figure 5:
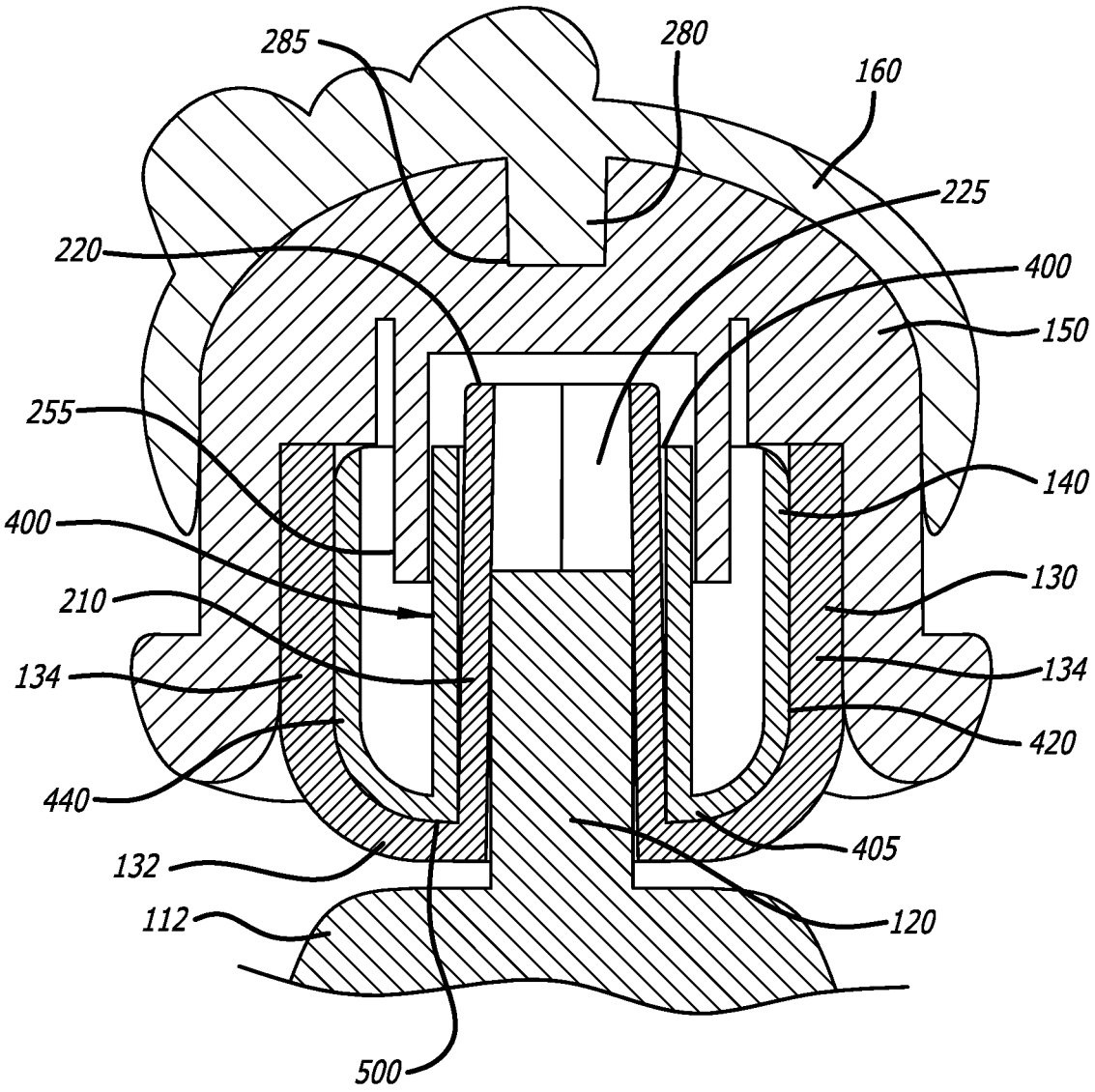
FIG. 5 is a front, cross-sectional view of an upper torso, the head support element, the removable head element and an ancillary attachment element of the toy figure of FIG. 1.

Referring now to FIG. 5, a front, cross-sectional view of the upper torso 112, the head support element 130, the removable head element 140, the head covering element 150, and the ancillary attachment element 160 of the toy FIG. 100 of FIG. 1 is shown. Herein, according to one embodiment of the disclosure, the first connector 120 extends from the upper torso 112. To securely coupled the body element 110 to the head support element 130, the first connector 120 is inserted into the conduit 225 associated with the second connector 210 until the first connector 120 is retained within the second connector 210.

Thereafter, a selected facial expression for the head element 140 is selected and the head element 140 is positioned within the cavity formed by the base 132 and the sidewalls 134 of the head support element 130. More specifically, the second conduit 400 of the head element 140 is aligned with the second connector 210 and slidably engaged with the second connector 210. As a result, the second conduit 400 of the head element 140 surrounds the outer surface of the second connector 210 and the bottom wall 405 and portions of the sidewalls (e.g., sidewalls 420 and 440 as shown) of the head element 130 are complementary in shape to the inner surface 500 of the head support element 130.

Upon placement of the head element 140 within the head support element 130, the head covering element 150 is coupled to the head support element 130. In particular, according to one embodiment of the disclosure, the third connector 255 of the head covering element 150 is positioned to surround at least the second end 220 of the second connector 210 and perhaps a portion of the second conduit 400 of the head element 140. The third connector 255 of the head covering element 150 may be lowered to encompass the second end 220 of the second connector 210 until inner edges 510 of the head covering element 150 make contact with top edges 230 of the head support element 130.

Optionally, the accessory attachment element 160 may include a fourth connector 280 for insertion into a corresponding connector 285 positioned and accessible from the top surface 265 of the head covering element 150.

In the foregoing description, the invention is described with reference to specific exemplary embodiments thereof. For example, for certain connector pairs, the male and female connectors may be switched between neighboring components. For example, the accessory attachment element 160 may deploy a female connector while the head covering element 150 may deploy a male connector. It will, however, be evident that various modifications and changes may be made thereto without departing from the broader spirit and scope of the invention as set forth in the appended claims.

What is claimed is:

1. A toy figure, comprising:

a body element including a first connector;

head support element including a second connector for coupling with the first connector, the head support element including a base partially surrounded by a plurality of sidewalls extending upwardly from a perimeter of the base to form a cavity and providing an opening between a first sidewall of the plurality of sidewalls and a second sidewall of the plurality of sidewalls;

a head element including a conduit for slidably engaging the second connector and residing within the cavity of the head support member, the head element including a plurality of facial expressions each placed on a different sidewall of the head element with a selected facial expression of the plurality of facial expressions being aligned with the opening, the plurality of expressions enables alteration of the selected facial expression of the toy figure based on rotation of the head element; and a head covering element including a third connector for coupling with the second connector, the head covering element positioned to remain adjacent to upper edges of the sidewalls to retain the head element within the cavity of the head support element.

2. The toy figure of claim 1, wherein the second connector corresponds to a cylindrical-shaped connector including a conduit, the second connector operating as both a female connector to receive the first connector of the body element and a male connector to receive the third connector.

3. The toy figure of claim 2, wherein the first connector is configured as post-shaped structure with a tapered end for insertion into the conduit to establish a secure coupling between the body element and the head support element.

4. The toy figure of claim 3, wherein the third connector is configured as a tube-shaped structure extending from the head covering element with a diameter that is slightly greater than a diameter of a second end of the second connector so as to at least slidably engage therewith.

5. The toy figure of claim 1, wherein the head element resides within the cavity to rest on the base of the head support member along with each sidewall of the head element, oriented laterally along a perimeter of the head element, being shaped complementary to an inner surface of a corresponding sidewall of the plurality of sidewalls of the head support element.

6. The toy figure of claim 1 further comprising an accessory attachment element removably coupled to an upper portion of the head covering element.

7. The toy figure of claim 1, wherein the head covering element is shaped as an astronaut helmet.

8. The toy figure of claim 1, wherein the head covering element is shaped as a selected type of hair style.

9. A toy figure, comprising:

a head support element including a base and a plurality of sidewalls extending upwardly from a portion of a perimeter of the base to form a cavity to partially surrounds a connector, and provides an opening between a first sidewall of the plurality of sidewalls and a second sidewall of the plurality of sidewalls; and a head element including a conduit for slidably engaging the connector and residing within the cavity of the head support member, the head element including a plurality of facial expressions each placed on a different sidewall of the head element with a selected facial expression of the plurality of facial expressions being aligned with the opening, the plurality of expressions enables alteration of the selected facial expression of the toy figure based on rotation of the head element.

10. The toy figure of claim 7 further comprising:

a body element including a second connector constructed for coupling with the connector of the head support element.

11. The toy figure of claim 10 further comprising:

a head covering element including a third connector for coupling with the connector of the head support element, the head covering element positioned in which an inner surface of the head covering element to remain adjacent to and in contact with upper edges of the sidewalls to retain the head element within the cavity of the head support element.

12. The toy figure of claim 11, wherein the connector corresponds to a cylindrical-shaped connector including a conduit, the connector operating as both a female connector to receive the second connector of the body element and a male connector to receive the third connector.

13. The toy figure of claim 12, wherein the third connector is configured as a tube-shaped structure extending from the head covering element with a diameter that is slightly greater than a diameter of a second end of the connector so as to at least slidably engage therewith.

14. The toy figure of claim 11, wherein a portion of the head covering element to further cover a first portion of the opening between the first sidewall and the second sidewall while retaining a second portion of the opening in alignment with the selected facial expression of the head element to provide the toy figure with the selected facial expression.

15. The toy figure of claim 14, wherein the head covering element is shaped as an astronaut helmet.

16. The toy figure of claim 14, wherein the head covering element is shaped as a selected type of hair style.

17. The toy figure of claim 16 further comprising an accessory attachment element removably coupled to an upper portion of the head covering element.

18. The toy figure of claim 10, wherein the connector corresponds to a cylindrical-shaped connector including a conduit, the connector operating as a female connector to receive the second connector of the body element.

19. The toy figure of claim 18, wherein the connector is configured as post-shaped structure with a tapered end for insertion into the conduit to establish a secure coupling between the body element and the head support element.

20. The toy figure of claim 9, wherein the head element resides within the cavity to rest on the base of the head support member along with each sidewall of the head element, oriented laterally along a perimeter of the head element, being shaped complementary to an inner surface of a corresponding sidewall of the plurality of sidewalls of the head support element.

* * * * *